US009046220B2

(12) United States Patent
Patterson et al.

(10) Patent No.: US 9,046,220 B2
(45) Date of Patent: Jun. 2, 2015

(54) PORT/LINER ASSEMBLY FOR PRESSURE VESSEL

(71) Applicant: HyPerComp Engineering, Inc., Brigham City, UT (US)

(72) Inventors: James Patterson, Brigham City, UT (US); Jared Noorda, Roy, UT (US)

(73) Assignee: HyPerComp Engineering, Inc., Brigham City, UT (US)

( * ) Notice: Subject to any disclaimer, the term of this patent is extended or adjusted under 35 U.S.C. 154(b) by 28 days.

(21) Appl. No.: 13/775,542

(22) Filed: Feb. 25, 2013

(65) Prior Publication Data

US 2013/0341337 A1 Dec. 26, 2013

Related U.S. Application Data

(60) Provisional application No. 61/662,069, filed on Jun. 20, 2012.

(51) Int. Cl.
*F17C 1/06* (2006.01)
*F17C 1/16* (2006.01)

(52) U.S. Cl.
CPC ... *F17C 1/06* (2013.01); *F17C 1/16* (2013.01); *F17C 2201/0109* (2013.01); *F17C 2201/056* (2013.01); *F17C 2203/0604* (2013.01); *F17C 2203/0619* (2013.01); *F17C 2203/066* (2013.01); *F17C 2203/067* (2013.01); *F17C 2205/0305* (2013.01); *F17C 2209/2145* (2013.01); *F17C 2209/228* (2013.01); *F17C 2221/011* (2013.01); *F17C 2223/0123* (2013.01); *F17C 2223/035* (2013.01); *F17C 2223/036* (2013.01); *F17C 2260/011* (2013.01); *F17C 2270/0168* (2013.01);

(Continued)

(58) Field of Classification Search
CPC ..... F17C 1/00; F17C 1/04; F17C 1/06; F17C 1/16
USPC ..... 220/586, 590, 601, 582, 592, 589
See application file for complete search history.

(56) References Cited

U.S. PATENT DOCUMENTS

| | | | |
|---|---|---|---|
| 4,438,858 | A | 3/1984 | Grover |
| 4,602,480 | A | 7/1986 | Hill |

(Continued)

FOREIGN PATENT DOCUMENTS

| | | |
|---|---|---|
| FR | 2 948 167 | 1/2011 |
| FR | 2 962 782 | 1/2012 |
| WO | 2007/079971 A1 | 7/2007 |

OTHER PUBLICATIONS

PCT/US2013/027582 International Search Report and Written Opinion dated May 8, 2013.

(Continued)

*Primary Examiner* — Fenn Mathew
*Assistant Examiner* — Don M Anderson
(74) *Attorney, Agent, or Firm* — Mueting, Raasch & Gebhardt, P.A.

(57) ABSTRACT

A pressure vessel includes a polymeric liner defining a fluid containment cavity and having an opening defining a port aperture extending between an inner surface and an outer surface of the polymeric liner and a rigid ring element is embedded within the polymeric liner and surrounding the port aperture. A metallic port element is disposed on the outer surface of the polymeric liner and fixed to the rigid ring element. A fiber composite material is disposed about the outer surface of the polymeric liner.

21 Claims, 3 Drawing Sheets

(52) U.S. Cl.
CPC ... *F17C 2270/0189* (2013.01); *F17C 2270/025* (2013.01); *F17C 2270/0754* (2013.01)

(56) References Cited

U.S. PATENT DOCUMENTS

| | | | | |
|---|---|---|---|---|
| 4,619,374 | A | 10/1986 | Yavorsky | |
| 4,705,468 | A | 11/1987 | LeBreton | |
| 4,732,634 | A | 3/1988 | Hill | |
| 4,740,262 | A | 4/1988 | Yavorsky | |
| 4,785,956 | A | 11/1988 | Kepler | |
| 5,025,943 | A | 6/1991 | Forsman | |
| 5,356,589 | A | 10/1994 | Sugalski | |
| 5,429,845 | A | 7/1995 | Newhouse | |
| 5,484,079 | A | 1/1996 | Carter | |
| 5,526,994 | A | 6/1996 | Murphy | |
| 5,556,497 | A | 9/1996 | Murphy | |
| 5,798,156 | A | 8/1998 | Mitlitsky | |
| 6,135,308 | A * | 10/2000 | Fang | 220/590 |
| 7,100,262 | B2 | 9/2006 | Carter | |
| 7,404,062 | B2 * | 7/2008 | Fleming et al. | 711/170 |
| 7,407,062 | B2 | 8/2008 | Carter | |
| 7,918,956 | B2 | 4/2011 | Mehta | |
| 2004/0104236 | A1 | 6/2004 | Sakaguchi | |
| 2008/0047963 | A1 * | 2/2008 | Wilson et al. | 220/582 |
| 2008/0251520 | A1 * | 10/2008 | Ota et al. | 220/586 |
| 2011/0220659 | A1 | 9/2011 | Strack | |

OTHER PUBLICATIONS

Towpreg Prove Cost-Competitive for Wound Pressure Vessels, *High Performance Composites*, www.compositesworld.com, pp. 36-39, Jul. 2003.

* cited by examiner

PORT/LINER ASSEMBLY FOR PRESSURE VESSEL

RELATED APPLICATION

This application claims the benefit of U.S. Provisional Patent Application No. 61/662,069 filed on Jun. 20, 2012, which provisional application is hereby incorporated herein by reference in its entirety to the extent that it does not conflict with the disclosure presented herein.

FIELD

The disclosure relates to a port/liner assembly for a pressure vessel.

BACKGROUND

Pressure vessels are utilized for many applications. These applications include self-contained breathing apparatuses, oxygen cylinders for medial and aircraft uses, fuel storage for alternative fuel vehicles, fire extinguishers, among others. Pressure vessels can be classified into one of four types: Type 1 is an all metal construction; Type 2 is a metal lined with fiber composite hoop wrap construction; Type 3 is a metal lined with a composite full wrap; and Type 4 is a plastic lined with composite full wrap.

A composite overwrapped pressure vessel (COPV) is a Type 4 vessel having a thin, non-structural liner wrapped with a structural fiber composite, designed to hold a fluid or gas under pressure. The liner provides a barrier between the fluid (e.g., gas) and the composite, preventing leaks (which can occur through composite matrix microcracks which do not cause structural failure) and chemical degradation of the structure. In general, a protective shell is applied for protective shielding against impact damage and as a primary structural element of the composite overwrapped pressure vessel. These composites can be fiber reinforced polymers (FRP), using carbon, fiberglass, and kevlar fibers. One advantage of a COPV as compared to a similar sized metallic pressure vessel is lower weight.

The vessel wall of a filament-reinforced plastic lined type IV pressure vessel or COPV is substantially continuous, and formed of a composite laminated structure. The inner portion or layer of the vessel wall is often a thermoplastic liner having an inner surface and an outer surface. The outer portion or layer of the vessel wall can be formed of overlapping helically-wound and hoop wound reinforcing filaments that are wet-wrapped with thermoset plastic and bonded to the outer surface of the thermoplastic liner.

As is the case with fluid-containment vessels, the aforementioned conventional thermoset and thermoplastic composite pressure vessels need at least one port, and frequently several ports, for providing access to fill and/or empty the vessel and/or for permitting the attachment of devices that monitor the pressure and/or other conditions within the interior of the vessel. These ports are commonly provided as rigid metallic fittings that are adapted to connect to hoses, pipes and/or measurement equipment (e.g., pressure sensors and gauges).

Unfortunately, bonding the rigid metallic port to the thermoplastic composite pressure vessels has proven to be difficult. It is commonly believed that, unless the port structure is bonded to the thermoplastic liner and the thermoset and filament reinforced outer layer, the mechanical strength of the pressure vessel is substantially weakened. Moreover, in conventional vessels, severing the continuous filament reinforcement can undermine the strength of the vessel.

Therefore, there exists a need in the art for an improved composite pressure vessel, and for a method for forming a port in a wall thereof. There further exists a need in the art for a fitting assembly that is adapted to be efficiently secured to the pressure vessel so as to define a port therein.

BRIEF SUMMARY

The present disclosure relates to a port/liner assembly for a pressure vessel, and specifically to a port/liner assembly for a thermoplastic composite pressure vessel. A rigid ring element surrounds a port aperture and is embedded within a seamless polymeric liner. A metallic port element is sealed to the seamless polymeric liner by being fixed to the rigid ring element.

In many embodiments, a pressure vessel includes a polymeric liner defining a fluid containment cavity and having an opening defining a port aperture extending between an inner surface and an outer surface of the polymeric liner and a rigid ring element is embedded within the polymeric liner and surrounding the port aperture. A metallic port element is disposed on the outer surface of the polymeric liner and fixed to the rigid ring element. A fiber composite material is disposed about the outer surface of the polymeric liner. The embedded rigid ring can also add stiffness support under an o-ring sealing element, helping to assure adequate seal under extreme conditions.

In further embodiments, a method includes molding polymeric material to form a polymeric liner defining a fluid containment cavity and having an opening defining a port aperture extending between an inner surface and an outer surface of the polymeric liner. A rigid ring element is embedded within the polymeric liner and surrounding the port aperture. Then the method includes disposing a metallic port element on the outer surface of the polymeric liner and being registered with the port aperture. The metallic port element is fixed to the rigid ring element. Then the method includes applying a fiber composite material about the outer surface of the polymeric liner to form a composite overwrapped pressure vessel.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The disclosure may be more completely understood in consideration of the following detailed description of various embodiments of the disclosure in connection with the accompanying drawings, in which.

Figure 1:
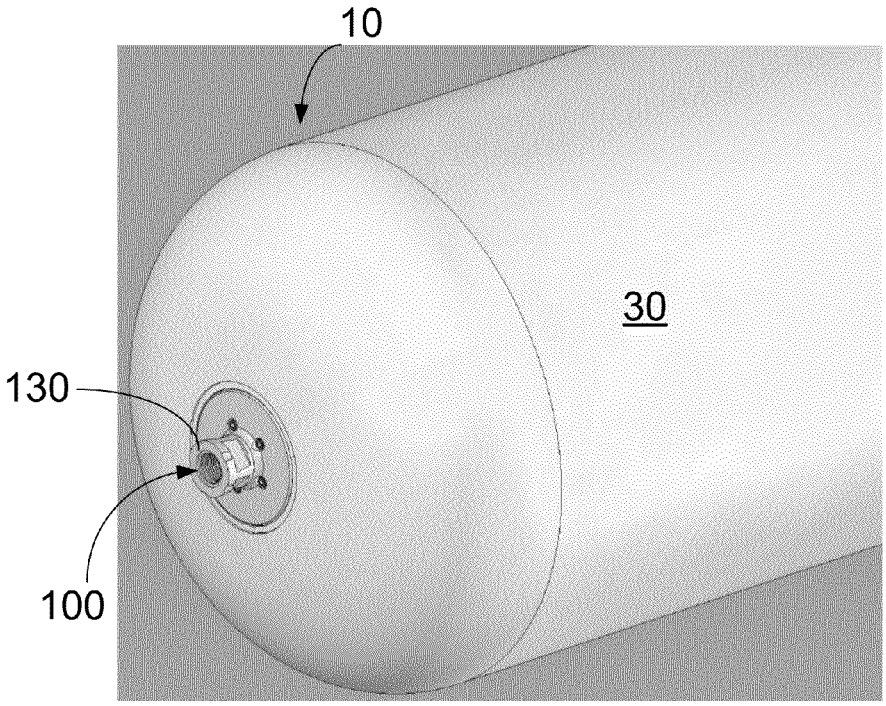
FIG. 1 is a schematic perspective view of an port assembly on a pressure vessel.

The schematic drawings presented herein are not necessarily to scale. Like numbers used in the figures refer to like components, steps and the like. However, it will be understood that the use of a number to refer to a component in a given figure is not intended to limit the component in another figure labeled with the same number. In addition, the use of different numbers to refer to components is not intended to indicate that the different numbered components cannot be the same or similar.

DETAILED DESCRIPTION

In the following detailed description, reference is made to the accompanying drawings that form a part hereof, and in which are shown by way of illustration several specific embodiments of devices, systems and methods. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

Any direction referred to herein, such as "top," "bottom," "left," "right," "upper," "lower," "above," below," and other directions and orientations are described herein for clarity in reference to the figures and are not to be limiting of an actual device or system or use of the device or system. Many of the devices, articles or systems described herein may be used in a number of directions and orientations.

The present disclosure relates to a port/liner assembly for a pressure vessel, and in particular to a port/liner assembly for a thermoplastic composite pressure vessel. The present disclosure utilizes molding, for example to form a seamless polymeric liner and embeds a metallic ring element into the seamless polymeric liner and about a port aperture. A metallic port element is then fixed to the embedded metallic ring element to provide a reliable seal. The design can incorporate an o-ring between an outer surface of the polymeric liner and the metallic port element to further ensure a reliable seal. While the present disclosure is not so limited, an appreciation of various aspects of the disclosure will be gained through a discussion of the examples provided below.

Figure 2:
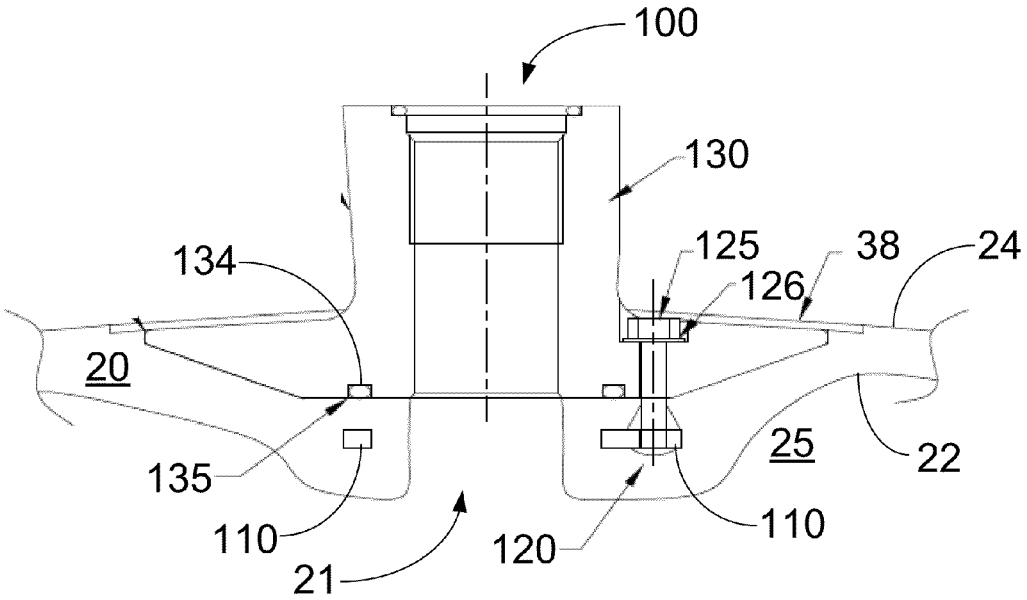
FIG. 2 is a schematic cross-sectional view of an illustrative port/liner assembly.
Figure 3:
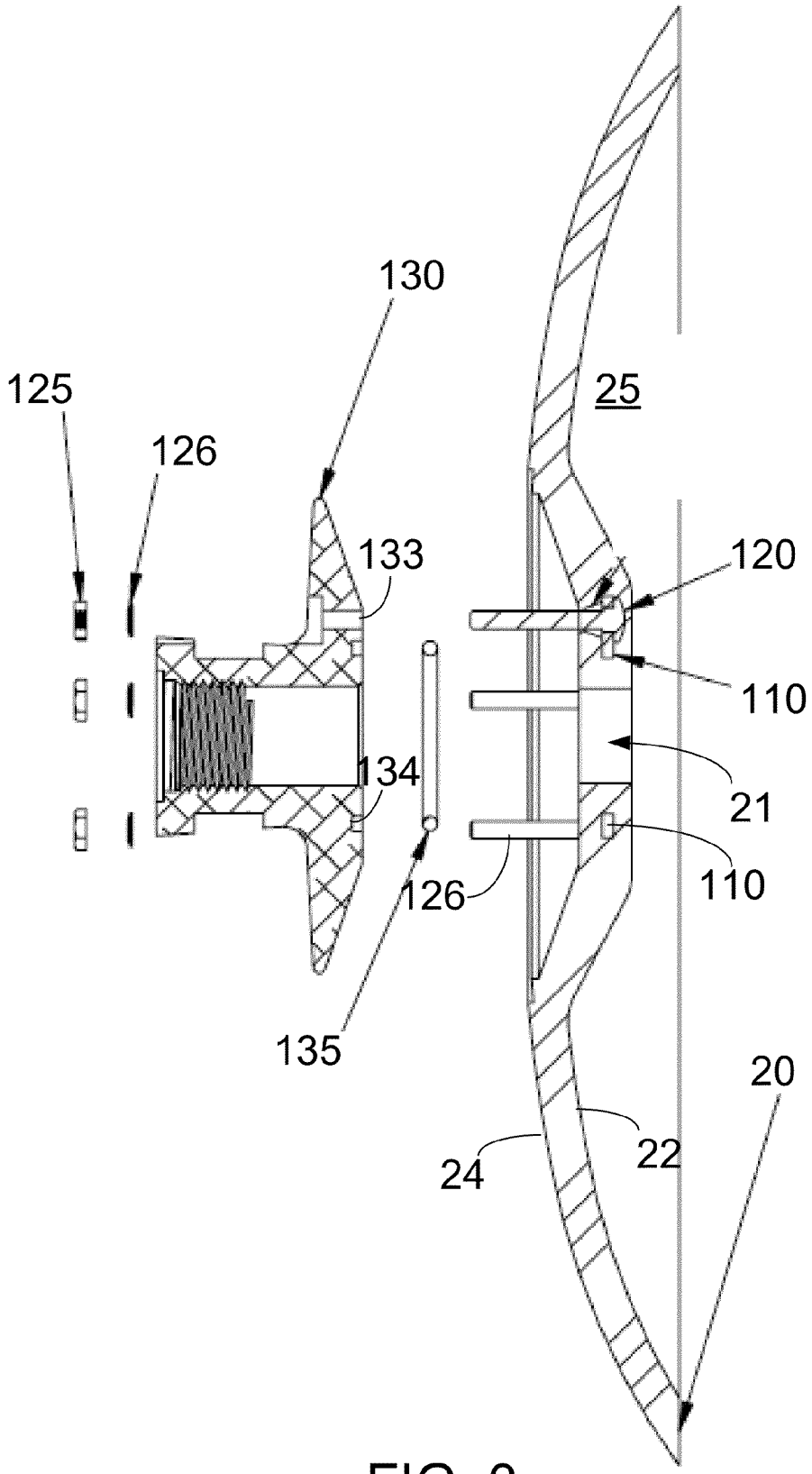
FIG. 3 is a exploded schematic cross-sectional view of an illustrative port/liner assembly of FIG. 2.
Figure 4:
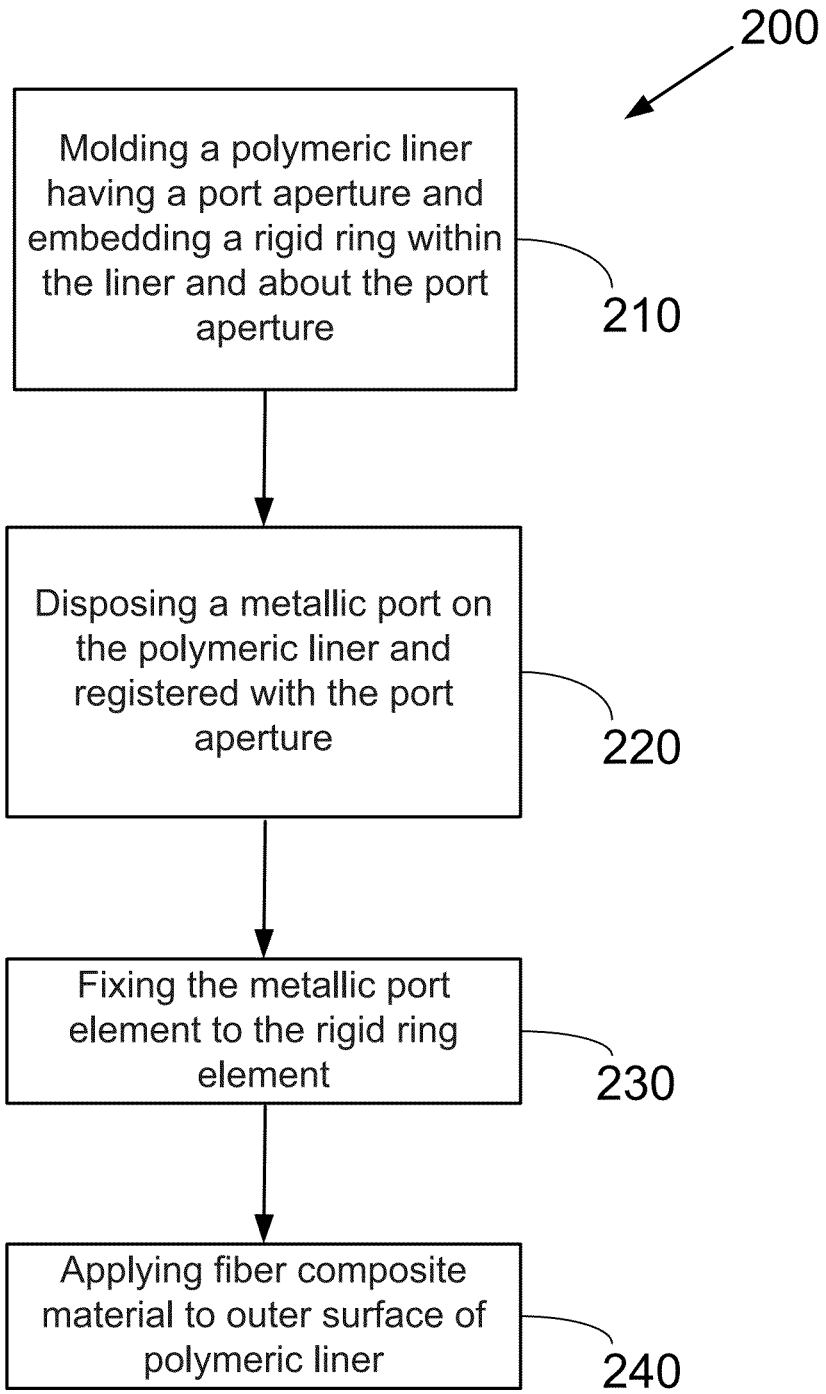
FIG. 4 is a flow diagram of an illustrative method of forming the illustrative port/liner assembly of FIG. 2.

FIG. 1 is a schematic perspective view of an port assembly on a pressure vessel 10. FIG. 2 is a schematic cross-sectional view of an illustrative port/liner assembly 100. FIG. 3 is a exploded schematic cross-sectional view of an illustrative port/liner assembly of FIG. 2. FIG. 4 is a flow diagram of an illustrative method of forming the illustrative port/liner assembly of FIG. 2.

A pressure vessel 10 includes a polymeric liner 20 defining a fluid containment cavity 25 and having an opening defining a port aperture 21 extending between an inner surface 22 and an outer surface 24 of the polymeric liner 20. The polymeric liner 20 can be formed by any useful method. In many embodiments the polymeric liner 20 can be formed by rotational molding or roto-molding to form a seamless polymeric liner 20 element. The liner 20 can be formed of any useful polymeric material such as polyethylenes, nylon, and the like, for example.

A rigid ring element 110 is embedded within the polymeric liner 20 and surrounding the port aperture 21. The rigid ring element 110 can be formed of any useful rigid material. In many embodiments the ring element 110 is formed of a metal such as aluminum, stainless steel, and the like. In other embodiments the ring element 110 is formed of a polymeric material or a ceramic material. In one particular embodiment, the rigid ring element 110 is formed of aluminum.

The rigid ring element 110 can be embedded within the polymeric liner 20 during the formation or molding process that forms the seamless polymeric liner 20. The ring element 110 can be embedded within the polymeric liner 20 and between the inner surface 22 and the outer surface 24 of the polymeric liner 20. As illustrated in FIG. 2, the ring element 110 is surrounded by the polymeric liner 20. At least a portion of the polymeric liner 20 separates the rigid ring element 110 from the inner surface 22. At least a portion of the polymeric liner 20 separates the rigid ring element 110 from the outer surface 24. In many embodiments, at least a majority of the rigid ring element 110 is covered on all sides by the polymeric liner 20. In some embodiments the rigid ring element 110 is embedded within the polymeric liner 20 about an equal distance from the outer surface 24 and the inner surface 22 of the polymeric liner 20.

It has been surprising found that utilizing the rigid ring element 110 allows for a reliable seal and assembly 100 formation as compared to molding the entire metallic port 130 to the polymeric liner 20. While not wishing to be bound by any particular theory, it is believed that incorporating the relatively smaller metal mass of the metallic ring element 110 into the polymeric liner 20 reduces heat-sink issues related to over-molding the polymeric liner 20 to a relatively larger metallic port 130. In many embodiments the rigid ring element 110 is a planar ring element and may be planar on its two opposing major surfaces. In many embodiments, the rigid ring element 110 is concentric with the port aperture 21.

A metallic port element 130 is disposed on the outer surface 24 of the polymeric liner 20 and fixed to the rigid ring element 110. In many embodiments the metallic port element 130 is fixed to the rigid ring element 110 via one or more or a plurality of fasteners 120. The fasteners 120 can be any useful elements such as rivets or bolts, and the like. In one embodiment the fasteners 120 are bolts.

In many embodiments the metallic port element 130 is fixed to the rigid ring element 110 via 3, 5 or 7 fasteners 120. The fastener 120 can extend though the rigid ring element 110. The fasteners 120 can extend though the metallic port 130 via a fasteners hole 133. The fastener 120 can have a head that is adjacent to the rigid ring element 110 and can be embedded within the polymeric liner 20 during the formation or molding process that forms the polymeric liner 20. The fastener 120 head can be embedded within the polymeric liner 20 and between the inner surface 22 and the outer surface 24 of the polymeric liner 20. In many embodiments the rigid ring element 110 is between the fastener 120 head and the outer surface 24 of the polymeric liner 20. In many embodiments, a bolt nut 125 and washer or constant force element 126 can be mated with the selected fastener or bolt 120 to mechanically secure the metallic port element 130 to the polymeric liner 20 via being fixed to the rigid ring element 110.

The constant force element 126 can be any element that expand and retain a relatively constant force between two elements. For example, the constant force element 126 can include a Belleville washer. A Belleville washer is a type of non-flat washer that has a slight conical shape which gives the washer a spring characteristic. They can be used to solve vibration, thermal expansion or contraction, relaxation and bolt creep. Their conical configuration enables them to support high loads with relatively small deflections and solid heights compared to helical springs. Thus, this constant force element 126 can be utilized in the port/liner assembly 100 to take up thickness contraction that may occur during depressurization (e.g., cold temperature contraction) of the pressure vessel 10.

In many embodiments, the assembly 100 further includes an o-ring 135 between the metallic port element 130 and the outer surface 24 of the polymeric liner 20. The o-ring 135 can seat into an o-ring recess 134 extending into the metallic port element 130. The o-ring 135 can be formed of any useful resilient material. The o-ring 135 is mechanically compressed between the metallic port element 130 and the outer surface 24 of the polymeric liner 20 to provide a reliable seal for the pressure vessel 10. In many embodiments the o-ring 135 is registered with the rigid ring element 110. At least a portion of the polymeric liner 20 separates the-ring 135 from the rigid ring element 110. A ply element 38 can be applied over the fastener or bolt 120, bolt nut 125 and washer or constant force element 126 to protect and cover these elements. The ply element 38 can be any useful material such as rubber, for example.

A fiber composite material 30 is disposed about the outer surface 24 of the polymeric liner 20. The fiber composite material 30 can be a combination of reinforcing fibers and resin. The reinforcing fibers can include glass fibers, aramid fibers, carbon fibers, and mixtures thereof, for example. The resin can include epoxy, polyester, vinylester, thermoplastic or any other suitable resinous material for a pressure vessel.

FIG. 4 is a flow diagram of an illustrative method 200 of forming the illustrative port/liner assembly of FIG. 2. The method 200 includes molding polymeric material to form a polymeric liner defining a fluid containment cavity and having an opening defining a port aperture extending between an inner surface and an outer surface of the polymeric liner, a rigid ring element is embedded within the polymeric liner and surrounding the port aperture at block 210. Then the method includes disposing a metallic port element on the outer surface of the polymeric liner and registered with the port aperture at block 220. A metallic port element is then fixed to the rigid ring element at block 230. Then the method includes applying a fiber composite material about the outer surface of the polymeric liner to form a composite overwrapped pressure vessel at block 240. In many embodiments, the molding step 210 includes molding polymeric material about all sides of the rigid ring element and embedding the rigid ring element between the inner surface and an outer surface of the polymeric liner.

Thus, embodiments of PORT/LINER ASSEMBLY FOR PRESSURE VESSEL are disclosed. One skilled in the art will appreciate that the port/liner assemblies and pressure vessels described herein can be practiced with embodiments other than those disclosed. The disclosed embodiments are presented for purposes of illustration and not limitation.

What is claimed is:

1. A pressure vessel, comprising:

a polymeric liner defining a fluid containment cavity and having an opening defining a port aperture extending between an inner surface and an outer surface of the polymeric liner;

a rigid ring element completely embedded within the polymeric liner and surrounding the port aperture;

a metallic port element disposed on the outer surface of the polymeric liner and removably fixed to the rigid ring element; and a fiber composite material disposed about the outer surface of the polymeric liner.

2. The pressure vessel of claim 1, wherein the rigid ring is a planar ring element.

3. The pressure vessel of claim 1, wherein the rigid ring element is between the inner and outer surface of the polymeric liner.

4. The pressure vessel of claim 1, wherein the rigid ring element is fixed to the metallic port element with a plurality of fasteners.

5. The pressure vessel of claim 4, further comprising a constant force element disposed on the plurality of fasteners.

6. The pressure vessel of claim 4, wherein the fasteners comprise a plurality of bolts extending through the metallic port element.

7. The pressure vessel of claim 1, further comprising an o-ring between the metallic port element and the outer surface of the polymeric liner.

8. The pressure vessel of claim 1, wherein the polymeric liner is seamless.

9. The pressure vessel of claim 1, wherein the rigid ring element is aluminum.

10. The pressure vessel of claim 1, wherein the rigid ring element is embedded within the polymeric liner about an equal distance from the outer surface and the inner surface.

11. The pressure vessel of claim 1, wherein the rigid ring element is concentric with the port aperture.

12. The pressure vessel of claim 4, wherein the plurality of bolts extend through the rigid ring element.

13. A pressure vessel, comprising:

a polymeric liner defining a fluid containment cavity and having an opening defining a port aperture extending between an inner surface and an outer surface of the polymeric liner;

a rigid ring element embedded within the polymeric liner and surrounding the port aperture and the rigid ring element is covered on all sides by the polymeric liner;

a metallic port element disposed on the outer surface of the polymeric liner and removably fixed to the rigid ring element by a fastener extending from the rigid ring element and through the polymeric liner; and a fiber composite material disposed about the outer surface of the polymeric liner.

14. The pressure vessel of claim 13, wherein the rigid ring is a planar ring element.

15. The pressure vessel of claim 13, wherein the rigid ring element is fixed to the metallic port element with a plurality of fasteners.

16. The pressure vessel of claim 13, further comprising a constant force element disposed on the fastener.

17. The pressure vessel of claim 13, wherein the fasteners comprise a plurality of bolts extending through the metallic port element.

18. The pressure vessel of claim 13, wherein the polymeric liner is seamless.

19. The pressure vessel of claim 13, wherein the rigid ring element is aluminum.

20. The pressure vessel of claim 13, wherein the rigid ring element is embedded within the polymeric liner about an equal distance from the outer surface and the inner surface.

21. The pressure vessel of claim 13, wherein the rigid ring element is concentric with the port aperture.

* * * * *